United States Patent [19]

Kuehnle

[11] 3,936,178

[45] Feb. 3, 1976

[54] APPARATUS FOR LARGE SCALE SCREEN DISPLAY OF IMAGES

[75] Inventor: Manfred R. Kuehnle, Lexington, Mass.

[73] Assignee: Coulter Information Systems, Inc., Bedford, Mass.

[22] Filed: Nov. 30, 1973

[21] Appl. No.: 420,668

[52] U.S. Cl. ..... 355/5

[51] Int. Cl.² ..... G03G 15/00

[58] Field of Search ..... 355/3, 5, 4

[56] References Cited

UNITED STATES PATENTS

| | | | |
|---|---|---|---|
| 3,051,044 | 8/1962 | McNaney | 355/5 |
| 3,115,075 | 12/1963 | Alexander | 355/5 |
| 3,168,857 | 2/1965 | Hutto | 355/5 |
| 3,679,301 | 7/1972 | Inoue | 355/4 |
| 3,732,007 | 5/1973 | Kushima | 355/5 |
| 3,788,739 | 1/1974 | Coriale | 355/3 |

*Primary Examiner*—John M. Horan

*Attorney, Agent, or Firm*—Silverman & Cass, Ltd.

[57] ABSTRACT

An electrophotographic film member is exposed to an image source, such as a cathode ray tube display unit, and the latent image toned to form a temporary visible image on said film member at a first station. The film member carrying the temporary visible image is stepwise translated to a projection station where it is projected in an enlarged display upon a suitable receptor surface. Thereafter, the film member is stepwise translated to an erase station where the toner is removed and the film member made ready for reuse to receive another image. The first station includes suitable structure for charging the film member, a selectively operable blind or shutter for exposing the charged film member to the image source and an applicator for applying suitable toner from a toner source to the exposed film member. The toner particles adhere tenaceously but removably to the exposed film member without any fixing or fusing process and hence, the toner can be removed from the film member afer projection. During charging and toning, the film member is maintained in darkness.

The electrophotographic film member is mounted in a window formed in a disc arranged for stepwise rotary translation from station to station. The electrophotographic film member comprises a thin film coating of an inorganic, photoconductive, electronically anisotropic material, one example of which is a specially sputtered cadmium sulfide bonded to a thin film layer of ohmic material which in turn is bonded to a thin stable substrate member preferably formed of plastic sheeting. The total thickness of the photoconductive coating is about 3,000 Angstroms and the ohmic layer is about 500 Angstroms. The film is durable with a hard abrasive resistant surface, is highly transparent and has high photoelectric gain. Its speed and sensitivity are such that a projectable transparency is formed almost immediately to enable projection of the received image almost as soon as it is received from the image source. The speed of the stepwise translation preferably is sufficient to provide successive projectable transparencies to the projection station fast enough to fall within the image retention capabilities of the human eye, thereby effecting a cinematographiclike display.

37 Claims, 4 Drawing Figures

APPARATUS FOR LARGE SCALE SCREEN DISPLAY OF IMAGES

CROSS-REFERENCES TO RELATED APPLICATIONS

Reference will be made herein to copending applications:

Ser. No. 389,149, filed Aug. 17, 1973, entitled "IMAGE RECORDING METHOD FOR ELECTROPHOTOGRAPHIC FILM";

Ser. No. 378,180, filed July 11, 1973, entitled "ELECTROPHOTOGRAPHIC FILM, METHOD OF MAKING AND USING THE SAME AND PHOTOCONDUCTIVE COATING USED THEREWITH";

Ser. No. 397,308, filed Sept. 14, 1973, entitled "TRANSPARENT PHOTOCELL";

Ser. No. 397,310, filed Sept. 14, 1973, entitled "DUPLICATOR PROCESSOR"; and

Ser. No. 397,309, filed Sept. 14, 1973, entitled "SHUTTERLESS CAMERA APPARATUS."

BACKGROUND OF THE INVENTION

The invention herein relates to the projection of optical images from a source to a display screen and specifically is directed to a method and apparatus for forming a projectable transparency from an image source and providing large screen display of said image, the transparency being formed on an electrophotographic film member.

Large scale display of photographic images is frequently utilized in conjunction with explanation of the data represented by said images before large groups of viewers. Ordinary photographic images are carried in the form of mounted transparencies and are introduced to projecting apparatus which project enlarged images onto a viewing screen. Often the large source carries information which is required to be displayed in enlarged form within a very short time span subsequent to its origination. Images displayed on cathode ray tube display units such as the video signal transmitted to a television receiver or information fed to an oscilloscope desirably are displayed on an enlarged scale for the presentation of important highly detailed information to a large audience. Government agencies, financial institutions and scientific gatherings are examples of such users. At present, considerable problems are encountered in achieving desirable large screen display from the aforementioned image sources. It is the practice to apply such images to strip material and process the same with conventional photographic techniques so that the information may be projected in enlarged condition upon a screen. With all presently known techniques, there is a substantial delay time between the origination of the image and the completion of the required transparency thereof to enable projection of that image. Conventional photographic film techniques require more processing time than electronic techniques such as videotaping but the enlargement and display of videotaped information requires complex and highly expensive apparatus.

Accordingly, it would be highly desirable to provide a method and apparatus for effecting large scale screen display of images from a source in which the processing time is materially reduced to a degree that the display can be projected "in real time," that is, almost instantaneously as derived from the source and further, it would also be desirable to effect such large screen display utilizing relatively inexpensive equipment, at substantially reduced frame by frame costs over conventional methods and apparatus and with a speed to provide a cinematographic display effect, if desired.

Another problem includes the present inability to provide high resolution images from sources of relatively low light intensity. Images received on a cathode ray tube display unit generally are of low intensity making photography difficult without unusual photographic conditions and very fast photographic film. Enlargement for display involving magnification of a substantial order also enlarges imperfections to the same degree. Resolution of the basic image must be of equal order relative to the resolution of the enlarged image. This factor, taken with the low intensity of the CRT image makes extremely difficult, if not impossible, photographic reproduction and subsequent large screen display of images of this character.

The advent of the electrophotographic film of the copending applications makes reproduction of images onto electrostatic members feasible and highly economical. Such electrophotographic film is a highly flexible, high speed, high gain, high resolution material with a hard and abrasion resistant surface. In addition, since the film is so fast and sensitive, it can respond quickly and easily even to the low light intensity of a cathode ray tube display unit image so as to provide excellent projectable images with a good gray scale. In addition, there is the capability for enhancing the received image forming a projectable transparency carrying an improved image over that received from the cathode ray tube display unit source.

SUMMARY OF THE INVENTION

The recording and projection system of the invention includes means for subjecting a suitably charged electrophotographic film to the image which is desired to be displayed, the exposure occurring under monitored light conditions, and toning the film to provide a temporarily visible record of the said image on the film at a first station; translating the toned film to a second station for projecting the image in an enlarged display upon a receptor surface and thereafter further translating the film to a third station where the film is readied for reuse by removal of the toner. Translation is stepwise, i.e., incremental. Provision is made at the first station for adjusting at least one of the factors involved in achieving an image on the film in response to the amount of light flux. Means further are provided to enable enhancing of the recorded image over the received image. Preferably, the source of the displayed image is a cathode ray tube display unit. In a preferred example, the charging, exposure and toning steps all are performed at the first station, the means for performing said steps being enclosed in a housing. The electrophotographic film is mounted within a window defined in a rotatable disk carrier with means constructed and arranged to rotate the carrier disk stepwise to advance the film through the various stations. Plural windows with like number of film members can be provided. A suitable projection system is utilized to apply the image from the cathode ray tube display unit to the film. The charge potential to which the electrophotographic film is charged is varied in accordance with the incident light in order to vary the sensitivity of the electrophotographic film.

In the latter embodiment of the invention, the incident light is measured by means of a light meter and the film charged, the amount of charge being measured by an electrostatic probe. The charging step occurs with the film in darkness. When the compared signals from the probe and the light meter reach the relationship which has been established by the circuit, the charging ceases, and means are operated to expose the charged film to the image. Thereafter, the electrophotographic film surface is flooded with toner, either in suspension or dry.

Toners which are at least temporarily self-adhering are utilized to enable the film to be translated to the projector station without loss of toner notwithstanding discharge of the film. Thus, toners, once electrostatically attracted by and adhered to the charged increments of the photoconductive coating of the film, will maintain their positions tenaciously so as to permit movement of the film without dislodgement of the toner in the absence of fixing. This is due to their intimate physical engagement with the surface and does not rely upon maintenance of the charge.

Image enhancement or contrast control may be effected by controlling the charging circuit for producing an optimum level of surface charge dependent upon light conditions. Image enhancement also may be effected by control of the time of toning and/or the bias applied during the toning step.

DESCRIPTION OF THE PREFERRED EMBODIMENTS

Figure 1:
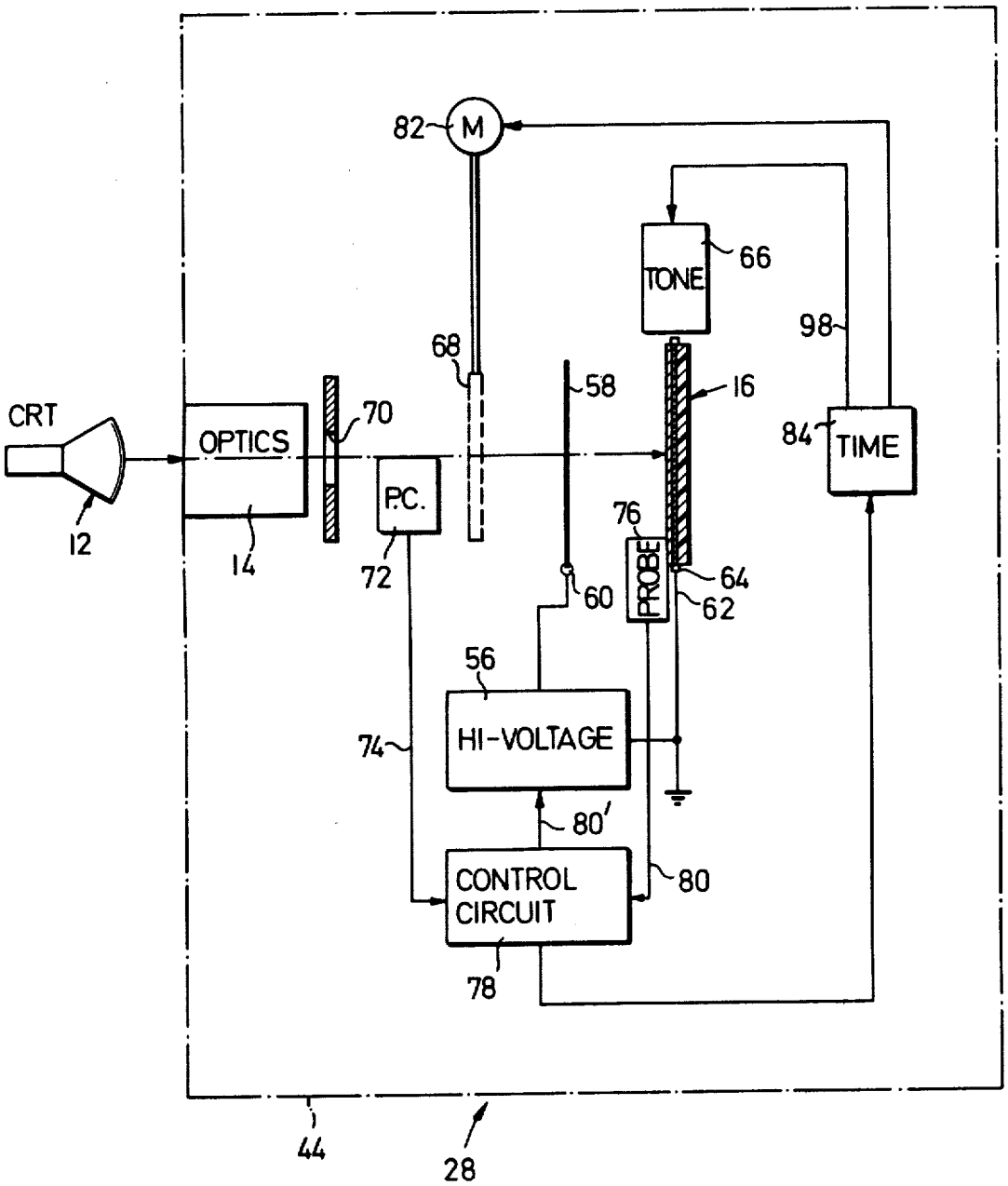
FIG. 1 is a highly schematic view showing the elements of the recording station constructed in accordance with the invention.

The invention as previously mentioned comprises a system for recording an image from a source upon an electrophotographic film and projecting said recorded image in large scale display for viewing by an audience, for example. The system of the invention particularly is capable of recording a scene or event displayed upon a conventional cathode ray tube display unit (CRT) and projecting that scene or event, in enlarged condition, upon a screen within a minimum time interval subsequent to appearance of the scene or event on the CRT. The system of the invention utilizes the electrophotographic film of copending application Ser. No. 378,180.

The electrophotographic film of the type which is described in the copending application Ser. No. 378,180 is illustrated in sectional view in the Figures and comprises a substrate member, for example, such as some stable plastic such as sold under the trademark "Mylar" by E. I. DuPont DeNemours Co. The substrate member is a fraction of a millimeter thick, has a conductive thin film coating intimately bonded thereto of a thickness of about 500 Angstrom units and carries another thin film coating of a photoconductive material about 3,000 Angstroms thick. The conductive coating can be made of indium oxide as deposited by radio frequency sputtering on the substrate member and the photoconductive member can be cadmium sulfide likewise sputtered as disclosed in said copending application Ser. No. 378,180.

When the surface of this electrophotographic film is charged by a corona, as through the use of a high voltage supply connected to a fine wire stretched in proximity to the surface of the photoconductive coating, there is an electrostatic corona effect which occurs. The high voltage supply is connected to the conductive coating and hence the surface of the conductive coating is charged with an excess of electrons disposed at the surface, the holes of the coating migrating toward the conductive coating. When the charged corona is removed, the charge corresponding to the electrons remains on or at the surface of the photoconductive coating but forms charge carriers which gradually seek to combine with holes in the coating. Assuming that the surface is kept in complete darkness, the rate at which the electrons move to a combined or stable distribution is represented by the so-called dark decay curve of the film.

If, instead of remaining in the darkness, the surface of the photoconductive coating has been subjected fully to a maximum light condition, the electrons would migrate from the surface of the photoconductive coating toward the conductive coating, being replaced by oppositely migrating holes and the charge potential on the surface of the coating which decay along the line represented by the so-called light decay curve. If there are any conditions of light between total darkness and maximum light, the charge at any increment at the surface of the photoconductive coating would decay at some intermediate rate thereby providing a myriad of different charge conditions all over the surface of the coating when the surface is subjected to a variegrated light pattern after having been charged.

Thus, if a light pattern has been projected onto the surface of the coating after it has been charged, the charge pattern which is produced on the surface comprises a latent image of the light pattern, but decays gradually according to the characteristics of the electrophotographic film which includes the ability to keep the charge gradations.

As understood from the discussions in the copending applications, if toner particles are distributed over the surface of the coating while the latent image is still present, the toner particles will adhere to the surface in proportion to the number of electrons present at any increment of surface. The toner particles are charged electrophoretically by suspension of these particles in suitable dielectric diluent which includes surfactants or may be applied in powdered or dry condition. The electric field represented by the distribution of electrons thus attracts the toner particles in proportion to the respective amount of charge of the increments. Thus, the latent image is "frozen" by the presence of the toner particles. If the toner is in the form of a suspension in some diluent, the particles usually adhere so long as their moisture remains. For many toners, even rapid-drying, the particles will adhere even with the charge fully decayed. In any event, there will be more than sufficient time for translation of the toned film member carrying the thus formed temporary visible image without concern for loss of particles even in the absence of a fixing step, providing the translation is effected smoothly and without jarring, etc., which could cause dislodgement. When desired, the layer of toner can be wiped off and the same film reused.

The film of the copending application, Ser. No. 378,180, is totally different from the xerographic and electrofax electrostatic members of the prior art. Its photoconductive coating is capable of accepting the charge very rapidly and may be charged to potentials which are substantially above saturation voltage without causing electrical breakdown. Saturation is understood to mean the surface potential at which further charge will not result in any increase in retained charge since the charge leaks off as fast as it is added. Conventional electrophotographic members are charged only to saturation because they will not accept the charge as fast as the film concerned herein. Notwithstanding this, the photoconductive coating of the subject film is so thin that the surface voltages involved are the order of ten times smaller than the voltage encountered in known apparatus, whereas the field strength is substantially higher.

The film of the copending application, Ser. No. 378,180, includes a photoconductive coating which is unique in many respects, one of which is if extremely high gain. Gain of a photoconductive coating is understood to mean the number of discharged electrons which is produced due to the impingement of a single photon. In the case of prior art photoconductive coatings as utilized in practical apparatus, a gain of more than one is considered excellent. The coating of the film concerned herein has a gain which can be as high as $10^6$ so that extremely large electrical currents are produced by the light received by the coating. This high gain characteristic means that the film is very fast and sensitive and provides a wide range of grey tones; hence, it is well suitable for recording the relatively low intensity CRT images.

Aside from the above, the film concerned herein is transparent, durable, and abrasion resistant, nonresponsive to light before charging and has no grain. The coatings are inorganic and hence inert to most conditions of heat and humidity which would destroy ordinary film. The substances from which the coatings are made form crystals as deposited, of a size that is invisible to the eye and substantially less in size than any known fine grain in conventional photographic films.

The sensitivity of the film can be adjusted automatically in accordance with the light which is impressed on the photoconductive coating. Since the higher the charging potential, the more sensitive the film, it is practical to use lower charging potentials when the light is greater. In short, the recording means, utilized in the recording and projecting system of the invention is constructed to charge the electrophotographical film member to a potential whose voltage varies inversely as the average incident light.

Reference is made to the copending applications for detailed explanation of the phenomena occurring in the practice of the invention herein and some explanation shall be provided hereinafter. The recording and projecting system for large scale screen display according to the invention is designated generally in the Figures by reference character 10. A high resolution, relatively small cathode ray tube display unit 12, hereafter referred to as the CRT 12, comprises the large source for the information intended to be represented in large screen display. A suitable optical train 14 is arranged to project the event as viewed on the CRT 12 to an electrophotographic film member 16. The electrophotographic film member 16 is of the type disclosed in the copending application, Ser. No. 378,180, and is mounted in a window 18 formed in a rotatable carrier disk 20. More than one window 18 and member 16 therein can be provided. The carrier disk 20 is mounted on a shaft 22 and coupled through suitable gearing and clutch means 24 to a drive motor 26. As will be explained hereinafter, the carrier disk is constructed and arranged to enable stepwise, i.e., incremental, translation of the film member for advancement thereof through the various stations of apparatus 10. The first station which shall be designated generally by reference character 28, in addition to including the optical train 14 for projecting the CRT image to the film member 16, includes means for charging, exposing and toning the electrophotographic film 16.

The second station 30 comprises a projection station which includes means including a light source 32 and a projection optical train 34 to effect enlargement and projection of the recorded, temporarily visible image on a large scale upon a distant screen 36. Once the utilization of the information displayed has been completed, the carrier disk is again translated stepwise to a third station 38 which shall be referred to as the erase station of the apparatus. Here, the visible image on the film member 16 is removed, as by wiping the toner from the film surface, or removing it through use of an electrical field, for example, so that the film member 16 is readied for reuse. Means for suitably controlling both the recording, projection, and erasure operations at the respective stations are coupled suitably to the drive means 26 incrementally to rotate the carrier disk 20 and advance the film member 16 to and through the various stations. The speed of rotation of disk 20 preferably is governed to place a different or successive projectable transparency at the projection station at a rate between 10 to about 30 times per second so that to take advantage of the human eye image persistence or retention providing a cinematographic effect — that is — the successive images would appear as continuous motion. As will be explained hereinafter, the time interval between the exposure of the CRT image and the projection of that image in enlarged condition upon the screen 36 for viewing is relatively short, almost providing near actual occurrence display of the said image. A key enabling factor therefore is attributable to the short processing time required to provide a projectable transparency of the aforesaid event and is particularly the product of the type of electrophotographic film which is utilized herein.

Figure 2:
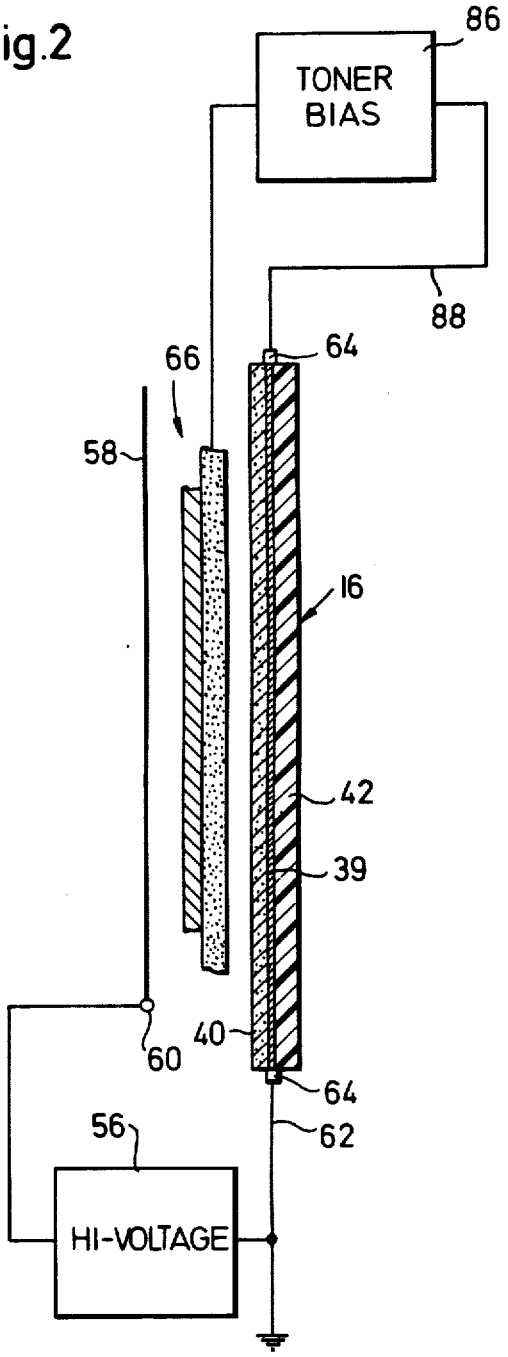
FIG. 2 is a fragmentary diagrammatic view through the electrophotographic film with the apparatus of the invention and showing preferable toning means used.

Referring to FIG. 2, there is illustrated the film member 16. The electrophotographic film member 16 comprises a thin film conductive outer coating 39 of ohmic material intimately bonded to thin film coating 40 of a photoconductive material which in turn has been deposited upon a substrate member 42. The photoconductive coating 40 can be sputtered cadmium sulfide as disclosed in the copending application, Ser. No. 378,180. The optical train 14 for projecting the CRT image to the film member 16, as well as the means for charging, exposing, and toning, are disposed in a housing 44, as are the suitable mechanisms and circuitry for operating the respective charging, exposing and toning means. The housing 44 includes a window 46 with which the window 18 is brought into alignment. Window 18 is provided with a surrounding frame 48, formed on opposite surfaces of the disk 20. Likewise, the window 46 also is provided with a frame 52. When aligned, the frames 48 and 52 are engageable to provide a lighttight enclosure with the housing 44 so that the electrophotographic film member 16 is charged and is toned in darkness. A backup plate 54 is provided to cooperate with the frame 50 at the rear surface of disk 20 to complete the lighttight enclosure of the film member 16 when the window 18 is correctly aligned with window 46 at the first station.

The surface of the electrophotographic film 16 is adapted to be charged by a corona established through the use of a high voltage supply 56 connected to a fine wire 58 which is secured to a charging head 60. The charging head 60 is arranged within the housing 44 near the window 46 so that the fine wire 58 is stretched thereacross in proximity to the surface of the photoconductive coating 40. The high voltage supply 56 is connected to the conductive coating 39 electrically by way of a conductor 62 adapted to engage conductor or tap 64 provided in frame 50 to enable electrical contact to be established when the window 18 is aligned with window 46. A toner device 66 is positioned within the housing 44 proximate to the window 46 thereof, and in a position to flood the surface of the film member 16 at a suitable time. The toner device 66 is positioned and enabled to operate only during the toning period which begins following the termination of the exposure period. The toning period requires that the toner cover the entire surface of the film 16.

A simple blind or shutter mechanism 68 unlike the complex photographic type shutter arrangements may be provided arranged in light-intercepting relationship between the optics 14 including the aperture 70 and the window 46. The blind permits light passage only during the exposure, and is in light-blocking relationship to the electrophotographic film 16 during the charging and during the toning.

The adjustable iris or aperture 70 is provided adjacent the optical train 14 for adjustment of the best depth of focus.

In accordance with the invention, a photocell 72 or other photoresponsive device is arranged in the housing 44 in position to intercept at least some of the light coming from the optical train 14 through iris 70 and is arranged between the iris 70 and the corona wire 58.

It may be advantageous to include the adjustable iris 70 within the optical train 14 and further to utilize the type of photocell structure described in copending application, Ser. No. 397,308, in which the photocell 72 is transparent and is coated on one of the lenses of the optical train 14 in order to intercept and to respond to all of the light passing through the optical train.

The corona produced when the suitable corona wire 58 is energized by the high voltage supply 56 connected thereto at head 60 produces a charge on the film 16 which is measured by means of a suitable electrometer including a probe 76 located at a position above to the photoconductive coating 40, preferably in a dark part thereof such as a corner of the frame 50. In this way, more uniform and predictable response can be obtained which can be related to the incident light for purpses of controlling the sensitivity of the electrophotographic film 16.

Assuming that the optical system 14 has been properly adjusted to focus the display from the CRT 12 on the surface of film 16 when the windows 18 and 46 are aligned, and the iris 70 has been properly adjusted to give the desired depth of field, the operator starts the electrical and/or mechanical system of the recording apparatus here at the first station 28. The charging of the surface 40 is commenced by the high voltage supply 56 and the surface potential commences to rise. At the same time, the photocell 72 measures the light from the CRT 12 and provides a signal which is channeled by the line 74 to a comparison device which is a part of the control circuit developed generally by reference character 78. The probe signal occurring on line 80 is also applied to the control circuit 78. Suitable circuitry for effecting such control is disclosed in copending application, Ser. No. 397,309, but other arrangements may be used.

When the control circuit 78 senses that the signals from the photocell 72 and the electrometer probe 76 have a given relationship, a signal is produced which disables the high voltage supply 56. The given relationship has been previously determined as optimum by suitable adjustments of the circuitry and measurements made. Certain kinds of comparison devices may be considered the equivalent of absence of a signal, in logic. The signals, for example, can appear on line 80'.

A simple form of relationship which can be built into the control circuit 76 would be one in which the disabling signal for cutting off the high voltage supply is produced when adjusted inputs to a differential amplifier are equal so that there is a change in the state of the output of the differential amplifier. At the time when the high voltage supply 56 is disabled, the blind 68 is activated by suitable drive means 82 to withdraw from its blocking position so that the film 16 is exposed. Timing means 84 controls the exposure time and after the elapse of said time, cause the drive means 82 to return the blind 68 to its blocking condition. At the termination of the exposure time, the toning device 66 is operated either manually or automatically to flood the surface 40 with liquid or powder toner.

Toner biasing means 86 are connected from the toner device 66 to the conductive layer 39 by lead 88 coupled to the conductive member 62 of the frame 50. It is feasible to apply a control signal to the toner biasing means 86 for adjusting the bias voltage in accordance with the surface potential reached for adjusting the image produced during toning. High potentials do not require as high a toner-propelling bias as low potentials. Such a control can serve as an alternate, say to the timing of the toner period, with the toner bias controlled by the intensity of the incident light as measured by the photoresponsive device 70.

Once the toning has been completed, the drive motor 26 for the carrier disk 20 can be energized and said carrier disk is rotated to translate the film member 16 to the second station 30. The second station 30 can be described as the projection station whereat the film member 16 which has now been transformed into a projectable transparency, is interposed between a light source 32 and a suitable projection optical train 34. With proper focusing, the image or scene picked up off of the CRT 12 and recorded on the film member 16 at station 28, can be projected in enlarged scale condition with great resolution and for as long as desired onto screen 36.

The light source 32 may be strong enough to electrically discharge the film 16 but since the attraction of the toner particles to the surface 40 is a physical one, by which the toner particles tenaciously will stick upon that surface, discharge of the surface will not have any serious effect upon the projectable transparency now comprising the film member 16. However, the light source 32 should not generate heat sufficient to fuse the toner particles upon the film 16. The fixing of the toned image is not desirable for this application. A suitable heat filter, such as an infrared filter 90 may be utilized to prevent reaching of such fusing temperatures.

After the desired time interval for viewing the large scale screen display, the drive motor 26, which can be a conventional stepping motor, once again is energized to rotate the carrier disk 20 to position the film member at the third station 38. Station 38 is an erase station whereat means, such as a rotating brush 96, may be activated for cleaning or wiping the toner off the surface 40 of the film 16. Such expedients as passing through an electrical field utilizing ultrasonic cleaning techniques, a blast of air or vacuum, or spraying the surface 40 with some solvent that will wash the toner away are acceptable. Because the coatings on the film 16 are inorganic, abrasion-resistant and corrosion-resistant, no problems are presented. This, of course, providing the substrate 42 is not affected by the toner removal process.

Once the toner is removed from the film member 16, the carrier disk 20 is once again rotated to translate the film member 16 back to the first station 28. Thus, it is evident that the film 16 is reusable repeatedly. If plural windows 18 are formed in the carrier disk 20, plural film members can be seated therein and the disk stepped through the stations successively with all films being utilized one after the other. In returning from the third station 38 back to the first station 28, it may be desirable to expose the film 16 to an extremely bright light as from lamp source 92 fully to discharge the coating 40 of any electrostatic charge it may have acquired in the process of translation.

It also is feasible for the charging step to be performed before the film member 16 intercepts the light from the optical train 14. Thus, the housing can consist of two stages, one in which the charging is performed and the other for exposure and toning.

The simple blind 68 may be replaced by a conventional, speed-adjustable shutter so that the apparatus has the capability of recording on the film member a display taken from a moving display appearing on the CRT 12.

Figure 4:
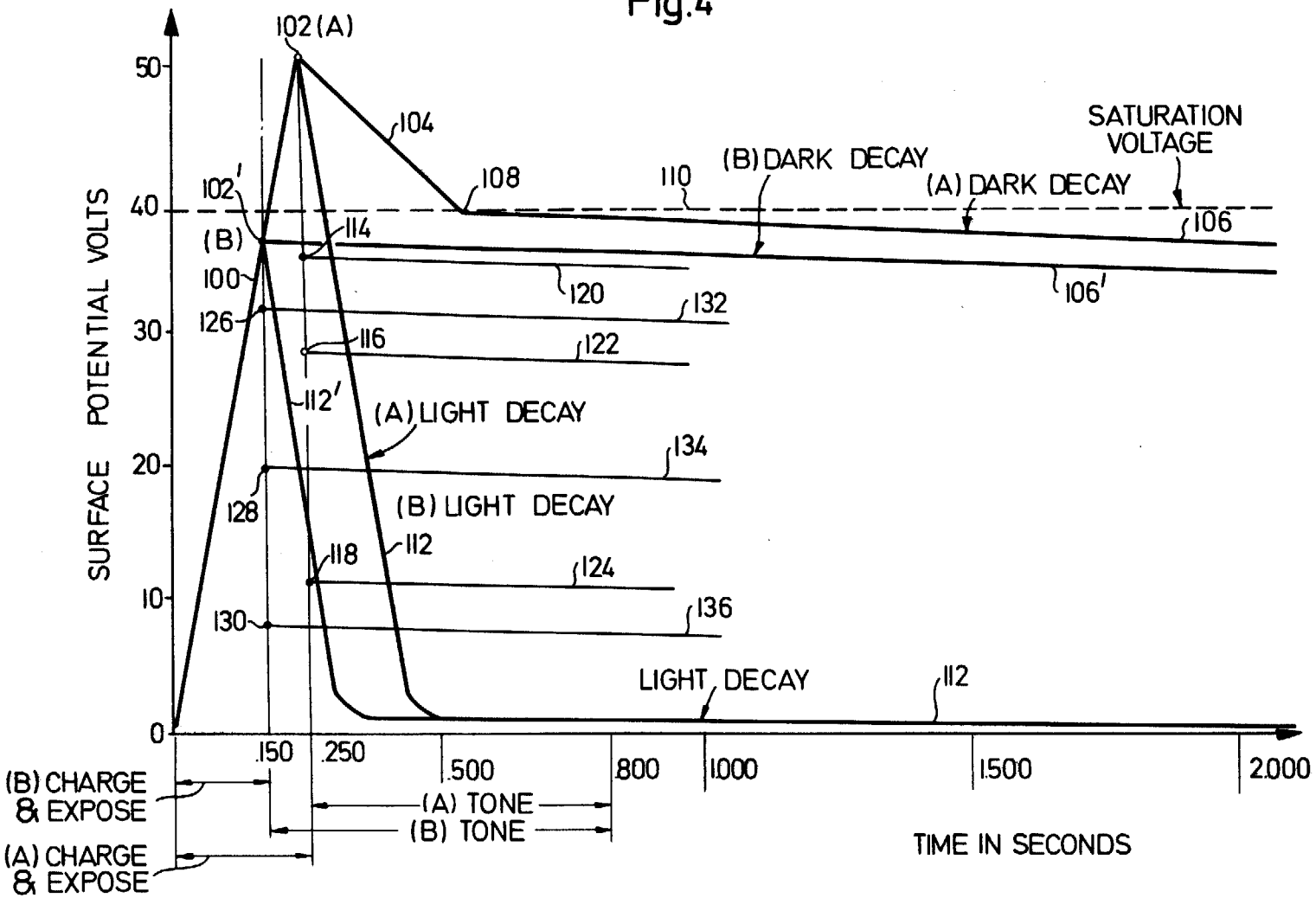
FIG. 4 is a chart or graph showing some of the characteristics of the electrophotographic film to be used in the apparatus and presented as an explanation of the phenomena that are believed to occur at the recording station.

Reference is made to the graph of FIG. 4 for a brief explanation of the phenomena involved in the charging, exposure and toning of film 16. Two conditions of ambient light are considered, one in which the amount of light is less than the other. These conditions are identified as condition A where the light from the scene to be recorded is low and condition B where the light from the scene is high. These are arbitrary conditions, no specific light values being reflected in the graph of FIG. 4, the only criterion being that the two light conditions differ one from the other.

Figure 3:
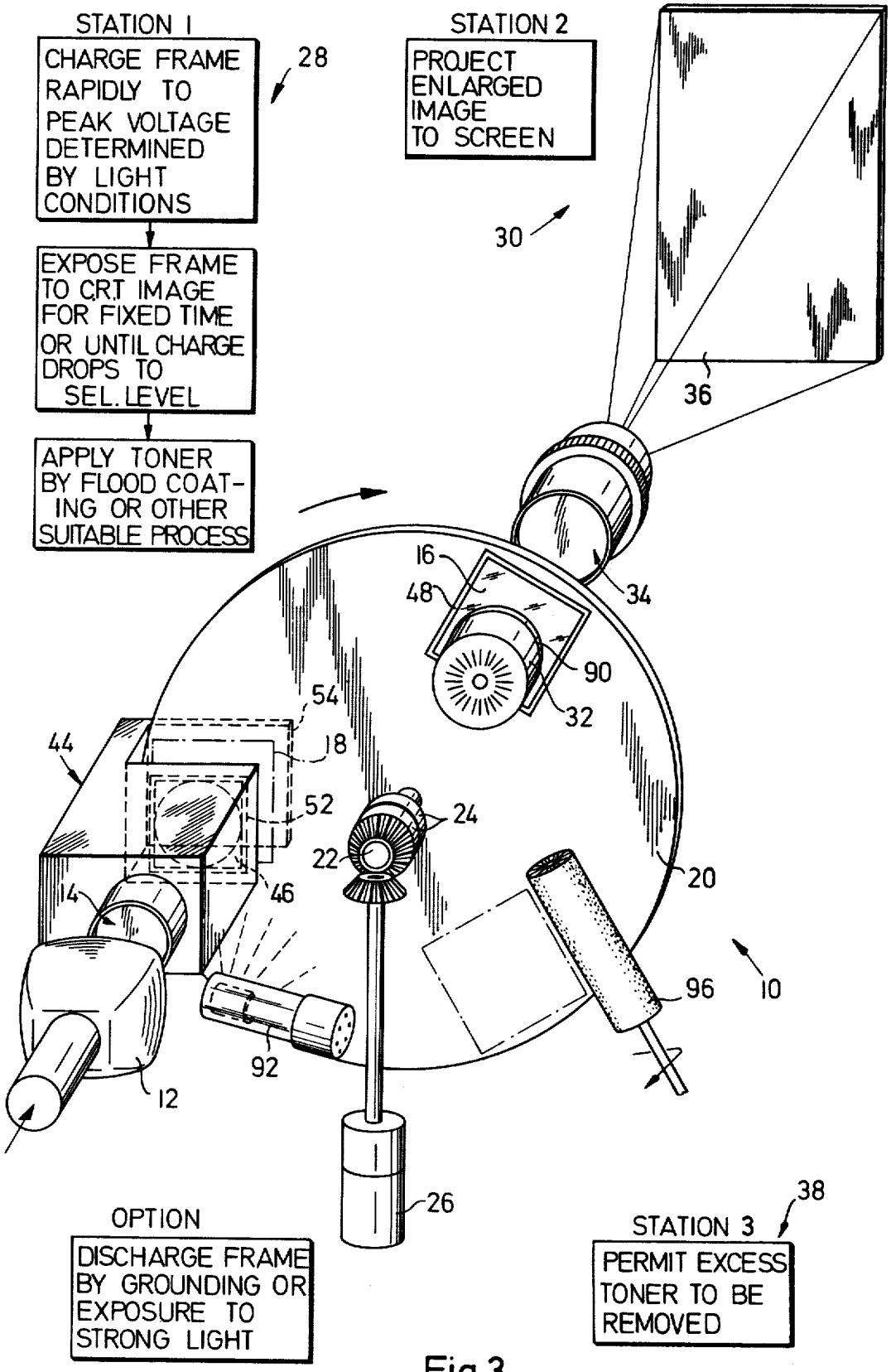
FIG. 3 is a highly diagrammatic view showing the basic components of an apparatus constructed in accordance with the invention and including a representation in block form of the steps of the method utilized.

The graph of FIG. 4 does not precisely illustrate the phenomena which occurs during the two conditions A and B but will be useful in explaining the operation of the apparatus under these two conditions. Reference is made to the copending applications for a more detailed recitation. In condition A, the surface potential of the coating 40 is expected to be higher than that for condition B. This is represented by the fact that the charge line 100 rises to the potential 102, which is about 52 volts in FIG. 3 for condition A but rises only to the potential 102' which is about 37 volts for the condition B.

The two maximum surface potential points 102 and 102' represent the charge reached at the increment of the film 16 which is in complete darkness and indeed in locating the measurement device for detecting surface potential, we have seen that it is placed at a location which will remain in darkness, the corner portion of the window 46. For condition A, the dark decay curve would follow the line 104, 106. The rapid dicharge from the point 102 to the point 108 represents the dark decay curve losing charge at a high rate since the point 102 is substantially above saturation level 110. The portion 106 of the dark decay curve for condition A has a very small slope which means that the charge is retained in the darkened areas for a relatively long period of time.

Now, assuming that there is an increment of the film 16 which has been fully charged in darkness, and that this increment is illustrated to the maximum, the potential of that increment will drop rapidly along the light decay curve 112 practically to zero. Toner particles will not adhere to any increments which have no charge and hence the areas which are represented by the flat portion of the curve 112 will be without any toner particles for the most part.

These extremes of charge, say at the time point .600 seconds demonstrate that the film is capable of extremes of toned and untoned areas, hence a very wide range of rays in contrast — this spelling practical photographic quality in enabling the production of a good projectable transparency.

At the end of a charging time, which is represented by the time line .250, three typical increments which were illuminated by different high intensities are illustrated as having the surface potentials represented by the points 114, 116, and 118. When the film is suddenly placed in darkness at this time, each of these increments commence to lose charge along intermediate dark decay curves 120, 122, and 124 respectively.

For condition B, the dark decay curve 106' starts at the point 102' but has no sharp drop equivalent to the portion 104 of the condition A dark decay curve because the point 102' is below saturation. Recall that this is for a light condition which has a greater intensity than the condition A and the film need not be as sensitive. Actually, the light decay curve 112' will not be as steep as the curve 112 because of the decreased gain. The higher charging voltage is not needed because the amount of light will be more than under condition A. The difference will be too little to notice on a graph of this scale.

Again, three differently illuminated increments will have different surface charge potentials as illustrated at 126, 128, and 130, all lying on the line 0.150 second. If placed in darkness at this time, the dark decay curves followed by the respective points would be 132, 134, and 136.

The time for the charging of condition B and likewise the exposure time comprise 0.150 second, which is less than for the condition A. The latter was a condition of low light intensity.

Ordinarily, the toning device 66 completes its operation at substantially the same time regardless of the total time of charge. This works out to be an advantage because the lower the surface charge potential of an electrostatic member, the longer the toning should be effected. This obtains from the principle that toner particles adhere more readily to higher potential charges. Thus, in the graph of FIG. 4, for the condition A the toning period is 0.550 second while for condition B the toning period is 0.650 second. Both toning periods end at 0.800 second so that it is relatively simple to build an electrical or mechanical device which will stop the toning at a predetermined time after the charging period commences, irrespective of how long the latter period is. In practically all cases, the toning time will give satisfactory results.

For image enhancement, it is feasible to have the toning timer means respond to the charging time or the surface potential, without regard to whether all toning periods end at the same time or not. The electrical or mechanical device operates in accordance with a predetermined relationship controlled by the charging time or surface potential.

It should be pointed out that the translative progress of one frame has been described, plural frames can be provided on the disk 20, spread apart equally about the circumference. Three, four, five or more are contemplated and feasible. The stepwise motion of the disk, that is, the frames thereon, can be synchronized with the CRT 12 to provide an incremental advance of the frames from 10 to about 30 frames per second to the projection station, thereby achieving the aforementioned cinematographic effect. For example, a conventional deflection circuit, can pick off the signals from the CRT and circuit 46 to govern the speed of the motor 26.

The apparatus 10 of the invention is capable of considerable variation in accordance with the teachings herein. The use of colored toner, other than black is contemplated. Different circuitry and mechanical means can be used to accomplish the functions which are described other than those already mentioned. The characteristics of the film 12 are such that the means are capable of a wide gamut of structure and circuitry. For example, since the surface of the film itself is glassy hard and highly abrasion resistant, mechanical means for handling and translating the film need not be especially constructed and protected to prevent contact with the film. Many variations are contemplated with respect to the provision of means to establish and maintain a lighttight enclosure in lieu of the described ooperating frame means. Also, the carrier means for the film member or plural members may be other than disk-shaped and, likewise, the translation of the carrier means other than rotary.

In the description and discussion above, some of the details which are quite obvious have been omitted. For example, the overall power supply for the apparatus 10 and its internal circuitry would normally be provided by batteries, either with or without an electrical attachment for connection to an external power source of electrical current. The photocell requires a constant current source such as might be provided by a battery. A switch could be provided to keep the photocell inoperative when the recording station is not in use so as to preserve the battery. Conventional servomotors may be utilized to drive the blind mechanism, as well as to effect notation of the carrier disk. The principal operating functions can be timed and programmed by suitable small motors or mechanical timers coordinating the positioning of the film with the operation of the means at the respective stations. Many functions may be manually effected by the operator, such as the translation of the carrier means, the projection of the recorded image to the screen as well as the toner removal.

In considering the construction of a practical apparatus, it has been explained herein that of the parameters which are involved, the adjustment of the charge potential on the surface of the film member 16 in relation to the incident light is most advantageous. The reason is that the sensitivity of the film is thereby controlled. It is feasible to keep the charging time constant, resulting in a fixed sensitivity of film in which case the aperture can be adjusted manually or automatically to provide the best light conditions for the fixed sensitivity. Other parameters which could be controlled, alone or in combination, are the time of toner application and the voltage of the toner bias to provide enhancement of the reproduced image over the relatively weak pattern appearing on the CRT 12.

What it is desired to secure by Letters Patent of the United States is:

1. A system for effecting an enlarged image display on a viewing screen and utilizing a transparent electrophotographic film member of the type having a photoconductive coating, said system comprising: translatable carrier means mounting at least one electrophotographic film member, means operable on the carrier means stepwise to position said electrophotographic film member successively at each of plural stations located along the path of movement of said carrier means, said plurality of stations comprising: a recording station including means for projecting a scene upon the film member and stationary means for successively charging, exposing and toning the film member forming a projectable transparency of said scene at said recording station, the film member and said stationary means being immobilized one relative to the other throughout the operation of the charging, exposing and toning means, a projection station for applying an enlarged image of said scene from said transparency upon a viewing screen and an erase station having means for removing all toner from said film member, a lighttight housing accommodating said means for charging, exposing and toning, said housing including a wall having window means formed therein for transmitting the projected light pattern representative of said scene to the film member when the same is aligned therewith, and said means for charging, exposing and toning includes a charging device proximate said window means for charging the coating of said film member sufficiently to raise the surface potential thereof to a selected potential value, means intermediate said optical train and said charging device for exposing said film member to said pattern only when said potential value is reached, means proximate to said window for applying toner to the film member subsequent to exposure, and means for controlling the applied charge on the film in relation to the incident light intensity.

2. The system as claimed in claim 1 in which said controlling means comprise means for measuring and comparing the charge potential on the film and the incident light intensity and control circuit means for providing a signal upon said charging device for controlling the applied charge.

3. The system as claimed in claim 2 in which said control circuit means includes means for disabling the charging device and said exposing means is operable immediately after the operation of said disabling means.

4. The system as claimed in claim 2 in which said potential measuring means comprise a voltage measuring device to derive a first signal which is a varying voltage which rises as the charge increases, said light intensity measuring means and deriving means include a photocell connected to an adjusting circuit whose parameters are adjusted to provide an output voltage having a predetermined characteristic for different values of light intensity, said last-mentioned output voltage being constant for any value of light intensity and comprising a second signal, said comparing means including a differential amplifier arranged in the control circuit to produce an output signal only when its two input signals are equal, said output signal of said differential amplifier comprises the third signal and occurs only when the first signal has risen to equal the second signal.

5. The system as claimed in claim 4 in which said third signal is connected to operate said blind mechanism for exposing the film member, and means are provided for timing the exposure period.

6. The system as claimed in claim 5 and means for timing the toning period in a predetermined relationship to the measured light intensity, the time of toning varying generally inversely with light intensity.

7. The system as claimed in claim 5 and said timing means also being operable upon said toning means for timing the toning period in a predetermined relationship relative to the surface potential.

8. The system as claimed in claim 1 and means operating said toning means immediately after exposure of the film member and means for disabling said toning means.

9. The system as claimed in claim 1 in which said exposing means comprise a blind mechanism arranged interposed between said means for projecting and the charging device and means for operating the blind mechanism to permit passage therepast of the light pattern representing said scene when said selected potential value is reached.

10. The system as claimed in claim 1 and means for applying a bias voltage to the toner during the toning period.

11. The system as claimed in claim 1 in which said carrier means comprise a carrier disk arranged for stepwise rotary movement, said stations being disposed at spaced locations along the circumferential path of said disk and means to establish a lighttight condition during the period while the film member is at the first station whereby the film member is charged and toned in darkness.

12. The system as claimed in claim 1 in which said controlling means include photoresponsive means for measuring the light intensity and positioned to intercept at least some of the light which is projected onto the film member.

13. The system as claimed in claim 1 in which said controlling means comprise transparent photoresponsive means for measuring light intensity and interposed in the light path so as to intercept the light projected onto the film member but to permit most of the light to pass through.

14. A system for effecting an enlarged image display on a viewing screen and utilizing a transparent electrophotographic film member of the type having a photoconductive coating, said system comprising: translatable carrier means mounting at least one electrophotographic film member, means operable on the carrier means stepwise to position said electrophotographic film member successively at each of plural stations located along the path of movement of said carrier means, said plurality of stations comprising: a recording station including means for projecting a scene upon the film member and means for charging, exposing and toning the film member forming in situ a projectable transparency of said scene at said recording station, the film member being immobilized during charging and exposing through the completion of the toning, a projection station for applying an enlarged image of said scene from said transparency upon a viewing screen and an erase station having means for removing all toner from said film member and said carrier means comprise a carrier arranged for stepwise rotary movement about its axis and said stations being arranged at spaced intervals along the path of movement of said film member with rotation of said carrier, means establishing a lighttight condition during the period when the film member is at the first station whereby the film member is charged and toned in darkness, said last-mentioned means including a frame on the carrier surrounding said film member to effect the lighttight condition on alignment of said film member with the scene projecting means at the first station.

15. The system for effecting an enlarged image display on a viewing screen and utilizing a transparent electrophotographic film member of the type having a photoconductive coating, said system comprising: translatable carrier means mounting at least one electrophotographic film member, means operable on the carrier means stepwise to position said electrophotographic film member successively at each of plural stations located along the path of movement of said carrier means, said plurality of stations comprising: a recording station including means for projecting a scene upon the film member and means for charging, exposing and toning the film member forming in situ a projectable transparency of said scene at said recording station, the film member being immobilized during charging and exposing through the completion of the toning, a projection station for applying an enlarged image of said scene from said transparency upon a viewing screen and an erase station having means for removing all toner from said film member, a lighttight housing accommodating said means for charging, exposing said toning, said housing including a wall having window means formed therein for transmitting the projected light pattern representative of said scene to the film member when same is aligned therewith, and said means for charging, exposing and toning includes a charging device proximate said window means for charging the coating of said film member sufficiently to raise the surface potential thereof to a selected potential value, means intermediate said optical train and said charging device for exposing said film member to said pattern only when said potential value is reached, means proximate to said window for applying toner to the film member subsequent to exposure, means for controlling the applied charge on the film in relation to the incident light intensity and said carrier means comprise a carrier disk having means for mounting the film thereon, said last-mentioned means comprise a window for carrying said film member and defining a corner area which is in darkness notwithstanding the projection of the light pattern onto the major portion of the film surface so that said corner area is charged during operation of the charging device, said controlling means including a voltmeter disposed in position to measure the surface potential of said corner area of the film member at the first station.

16. A system for effecting an enlarged image display on a viewing screen and utilizing a transparent electrophotographic film member of the type having a photoconductive coating, said system comprising: translatable carrier means mounting at least one electrophotographic film member, means operable on the carrier means stepwise to position said electrophotographic film member successively at each of plural stations located along the path of movement of said carrier means, said plurality of stations comprising: a recording station including means for projecting a scene upon the film member and means for charging, exposing and toning the film member forming in situ a projectable transparency of said scene at said recording station, the film member being immobilized during charging and exposing through the completion of the toning, a projection station for applying an enlarged image of said scene from said transparency upon a viewing screen and an erase station having means for removing all toner from said film member, a lighttight housing accommodating said means for charging, exposing and toning, said housing including a wall having window means formed therein for transmitting the projected light pattern representative of said scene to the film member when same is aligned therewith, and said means for charging, exposing and toning includes a charging device proximate said window means for charging the coating of said film member sufficiently to raise the surface potential thereof to a selected potential value, means intermediate said optical train and said charging device for exposing said film member to said pattern only when said potential value is reached, means proximate to said window for applying toner to the film member subsequent to exposure and means for controlling the applied charge on the film in relation to the incident light intensity, and said controlling means comprise a transparent photocell, the means for projecting including an optical train having at least one lens, said photocell comprising a pair of electrically conductive layers sandwiching an intervening thin film inorganic photoconductive layer intimately bonded thereto and capable of having a potential established thereacross with current flow being a measure of intensity of light passing therethrough, one of said electrically conductive layers being intimately bonded to a surface of said lens.

17. A system for effecting a large scale screen display of an image from a source and utilizing a transparent electrophotographic film member of the type having a photoconductive coating, said system comprising:

A. translatable carrier means and at least one electrophotographic film member mounted thereon, said electrophotographic film member having a photoconductive coating;

B. means for effecting stepwise translation of said carrier means to position said electrophotographic film member progressively and successively at each of plural stations located along the path of said carrier means for performance of operations upon said film member;

C. an image source; and

D. said plurality of stations comprising:

i. a recording station including 1. optical train means for receiving an image from said source and projecting said image upon the film member; and 2. aligned means at a fixed location for charging, exposing and toning the film member successively while the film member and said aligned means are relatively immobilized throughout the charging, exposing and toning to form a temporarily visible projectable transparency of said image at said recording station;

ii. a projection station, including a light source and projecting means, for applying the image from said transparency to a receptor surface in large scale display; and iii. an erase station having means for removing all toner from said transparency to provide a clean film member for reuse at said recording station, a lighttight housing accommodating said means for charging, exposing and toning, said housing including a wall having window means formed therein for transmitting the projected light pattern representative of said scene to the film member when the same is aligned therewith, and said means for charging, exposing and toning includes a charging device proximate said window means for charging the coating of said film member sufficiently to raise the surface potential thereof to a selected potential value, means intermediate said optical train and said charging device for exposing said film member to said pattern only when said potential value is reached, means proximate to said window for applying toner to the film member subsequent to exposure, and means for controlling the applied charge on the film in relation to the incident light intensity.

18. The system as claimed in claim 17 in which said control circuit means include means operating to disable the charging device and means operable immediately subsequent to the operation of said disabling means to expose the film member.

19. The system as claimed in claim 17 in which said exposure means comprise a blind mechanism arranged between said optical train and the charging device and means for operating the blind mechanism to permit passage therepast of a light pattern representing said scene when said selected potential value is reached.

20. The system as claimed in claim 19 in which said third signal is connected to enable said blind mechanism for exposing the film member, and means are provided for timing the exposure period.

21. The system as claimed in claim 20 in which there are means for timing the toning period in a predetermined relationship to the measured light intensity, the time of toning varying generally inversely with light intensity.

22. The system as claimed in claim 20 and said timer means also operable upon said toning means for timing the toning period in a predetermined relationship relative to the surface potential.

23. The system as claimed in claim 17 and means for applying a bias voltage to the toner during the toning period.

24. The system as claimed in claim 17 in which the means for measuring the light intensity comprise photoresponsive means located on the interior of the housing and arranged to intercept at least some of the light which is projected onto the film member.

25. A system for effecting a large scale screen display of an image from a source and utilizing a transparent electrophotographic film member of the type having a photoconductive coating, said system comprising:

A. translatable carrier means and at least one electrophotographic film member mounted thereon, said electrophotographic film member having a photoconductive coating;

B. means for effecting stepwise translation of said carrier means to position said electrophotographic film member progressively and successively at each of plural stations located along the path of said carrier means for performance of operations upon said film member;

C. an image source; and

D. said plurality of stations comprising;

i. a recording station including 1. optical train means for receiving an image from said source and projecting said image upon the film member; and 2. means for charging, exposing and toning the film member successively while the film member is immobilized until toning is completed to form a temporarily visible projectable transparency of said image;

ii. a projection station, including a light source and projecting means, for applying the image from said transparency to a receptor surface in large scale display; and iii. an erase station having means for removing all toner from said transparency to provide a clean film member for reuse at said recording station;

E. a lighttight housing structure accommodating said means for charging, exposing and toning disposed within said enclosure and including a charging device for charging the coating of said film member sufficiently to raise the surface potential thereof to a selected potential value, means intermediate said optical train and said charging device for exposing said film member to said pattern only when said potential value is reached, means for applying toner to the latent image formed on the film member subsequent to exposure thereof, means for measuring and comparing the charge potential on the coating of the film and the incident light intensity, and control circuit means operable upon said charging device for controlling the applied charge in relation to said measured light intensity, and said potential measuring means comprise voltage measuring means comprising a voltage measuring device to derive a first signal which is a varying voltage which rises as the charge increases, said light intensity measuring means and deriving means include a photocell connected to an adjusting circuit whose parameters are adjusted to provide an output voltage having a predetermined characteristic for different values of light intensity, said last-mentioned output voltage being constant for any value of light intensity and comprising a second signal, said comparing means including a differential amplifier arranged in the control circuit to produce an output signal only when its two input signals are equal, said output signal of said differential amplifier comprises the third signal and occurs only when the first signal has risen to equal the second signal.

26. A system for effecting a large scale screen display of an image from a source and utilizing a transparent electrophotographic film member of the type having a photoconductive coating, said system comprising:

A. translatable carrier means and at least one electrophotographic film member mounted thereon, said electrophotographic film member having a photoconductive coating;

B. means for effecting stepwise translation of said carrier means to position said electrophotographic film member progressively and successively at each of plural stations located along the path of said carrier means for performance of operations upon said film member;

C. an image source; and

D. said plurality of stations comprising:

i. a recording station including 1. optical train means for receiving an image from said source and projecting said image upon the film member; and 2. means for charging, exposing and toning the film member successively while the film member is immobilized until toning is completed to form a temporarily visible projectable transparency of said image;

ii. a projection station, including a light source and projecting means, for applying the image from said transparency to a receptor surface in large scale display; and iii. an erase station having means for removing all toner from said transparency to provide a clean film member for reuse at said recording station;

E. said recording station includes a housing structure having said means for charging, exposing and toning disposed therein, and means for defining a lighttight enclosure while the film member is positioned at said recording station during formation of the projectable transparency, and F. said carrier means comprise a carrier disk arranged for rotary movement stepwise from station to station about a shaft, each of said stations being disposed at spaced locations along the periphery of said disk and said means to establish a lighttight enclosure being on the housing and the disk said charging and toning being performed in darkness.

27. The system as claimed in claim 26 in which said carrier disk has at least one window formed therein, said film member mounted within said window, said window having a surrounding frame and said means establishing a lighttight condition includes the surrounding frame on the disk cooperating with the said housing to effect said condition when the window of the carrier disk is aligned with the optical train means at the first station.

28. A system for effecting a large scale screen display of an image from a source and utilizing a transparent electrophotographic film member of the type having a photoconductive coating, said system comprising:

A. translatable carrier means and at least one electrophotographic film member mounted thereon, said electrophotographic film member having a photoconductive coating;

B. means for effecting stepwise translation of said carrier means to position said electrophotographic film member progressively and successively at each of plural stations located along the path of said carrier means for performance of operations upon said film member;

C. an image source; and

D. said plurality of stations comprising:

i. a recording station including 1. optical train means for receiving an image from said source and projecting said image upon the film member; and 2. means for charging, exposing and toning the film member successively while the film member is immobilized until toning is completed to form a temporarily visible projectable transparency of said image;

ii. a projection station, including a light source and projecting means, for applying the image from said transparency to a receptor surface in large scale display; and iii. an erase station having means for removing all toner from said transparency to provide a clean film member for reuse at said recording station, and E. said carrier means comprise a carrier disk having means for mounting the film thereon, said mounting means comprise a window carrying said film member and having an area which is in darkness notwithstanding the projection of the light pattern onto the major portion of the film surface so that said area is charged during operation of the charging device, and measuring means disposed in position to measure the surface potential of said area of the film member.

29. A system for effecting a large scale screen display of an image from a source and utilizing a transparent electrophotographic film member of the type having a photoconductive coating, said system comprising:

A. translatable carrier means and at least one electrophotographic film member mounted thereon, said electrophotographic film member having a photoconductive coating;

B. means for effecting stepwise translation of said carrier means to position said electrophotographic film member progressively and successively at each of plural stations located along the path of said carrier means for performance of operations upon said film member;

C. an image source; and

D. said plurality of stations comprising:

i. a recording station including 1. optical train means for receiving an image from said source and projecting said image upon the film member; and 2. means for charging, exposing and toning the film member successively while the film member is immobilized until toning is completed to form a temporarily visible projectable transparency of said image;

ii. a projection station, including a light source and projecting means, for applying the image from said transparency to a receptor surface in large scale display; and iii. an erase station having means for removing all toner from said transparency to provide a clean film member for reuse at said recording station, E. a lighttight housing structure accommodating said means for charging, exposing and toning being disposed within said enclosure and including.

a charging device for charging the coating of said film member sufficiently to raise the surface potential thereof to a selected potential value, means intermediate said optical train and said charging device for exposing said film member to said pattern only when said potential value is reached, means for applying toner to the latent image formed on the film member subsequent to exposure thereof, means for measuring and comparing the charge potential on the coating of the film and the incident light intensity, and control circuit means operable upon said charging device for controlling the applied charge in relation to said measured light intensity; and F. the means for measuring the light intensity comprise transparent photoresponsive means interposed in the light path at the first station.

30. A system for effecting a large scale screen display of an image from a source and utilizing a transparent electrophotographic film member of the type having a photoconductive coating, said system comprising:

A. translatable carrier means and at least one electrophotographic film member mounted thereon, said electrophotographic film member having a photoconductive coating;

B. means for effecting stepwise translation of said carrier means to position said electrophotographic film member progressively and successively at each of plural stations located along the path of said carrier means for performance of operations upon said film member;

C. an image source;

D. said plurality of stations comprising:

i. a recording station including 1. optical train means for receiving an image from said source and projecting said image upon the film member; and 2. means for charging, exposing and toning the film member successively while the film member is immobilized until toning is completed to form a temporarily visible projectable transparency of said image;

ii. a projection station, including a light source and projecting means, for applying the image from said transparency to a receptor surface in large scale display; and iii. an erase station having means for removing all toner from said transparency to provide a clean film member for reuse at said recording station, E. a lighttight housing structure accomodating said means for charging, exposing and toning being disposed within said enclosure and including, a charging device for charging the coating of said film member sufficiently to raise the surface potential thereof to a selected potential value, means intermediate said optical train and said charging device for exposing said film member to said pattern only when said potential value is reached, means for applying toner to the latent image formed on the film member subsequent to exposure thereof, means for measuring and comparing the charge potential on the coating of the film and the incident light intensity, and control circuit means operable upon said charging device for controlling the applied charge in relation to said measured light intensity, and F. the means for measuring the light intensity comprise a transparent photocell, the optical train including at least one lens and the photocell is coated onto a surface of said lens.

31. Apparatus for temporarily recording a light pattern on electrophotographic film having a photoconductive coating and projecting said recorded light pattern in a large scale display upon a screen surface, said apparatus comprising: carrier means for holding at least one electrophotographic film member, a housing providing a lighttight enclosure and arranged to receive said electrophotographic film member in a lighttight relationship therewith, said film member having a photoconductive coating, a light pattern source exterior of said housing, projection means exterior of said housing arranged to apply said light pattern to said photoconductive coating, means within the housing proximate to said film member for charging the coating while same is in darkness, means for sensing the absolute potential of the charged coating and simultaneously, for sensing the flux of said light pattern and deriving respective signals from the potential and flux, a control circuit operated by said signals and having a predetermined characteristic which provides an output signal for any level of light flux when the charge potential sensed reaches a chosen value corresponding to any particular flux level and built into said characteristic, means driven by the output signal of the control circuit to disable said charging means and simultaneously to expose said charged coating to said light pattern, means enclosure for applying toner to the film member subsequent to exposure thereof, means for adjusting the time of toning and disabling said toner means after a predetermined time interval, both said film member and said means for charging, exposing and toning being immobilized one relative to the other throughout the charging, exposure and toning, a projector arrangement, including a light source and an optical train, arranged spaced from said housing for receiving the toned electrophotographic film member and capable of projecting the recorded light pattern upon the screen surface, toner removal means arranged spaced from said projector means and adapted to receive said toned electrophotographic film subsequent to projection for removal of all toner therefrom and means for stepwise translating said carrier means to bring said electrophotographic film member successively to said housing, said projection means, said toner removal means and again to said housing in that order, said housing accommodating said means for charging, exposing and toning, said housing including a wall having window means formed therein for transmitting the projected light pattern representative of said scene to the film member when the same is aligned therewith, and said means for charging, exposing and toning includes a charging device proximate said window means for charging the coating of said film member sufficiently to raise the surface potential thereof to a selected potential value, means intermediate said optical train and said charging device for exposing said film member to said pattern only when said potential value is reached, means proximate to said window for applying toner to the film member subsequent to exposure, and means for controlling the applied charge on the film in relation to the incident light intensity.

32. Apparatus as claimed in claim 31 in which the stepping rate is in the range between about 10 to 30 frames per second so that the projected recorded light pattern appears as continuous motion.

33. Apparatus as claimed in claim 31 in which said light pattern source comprises a cathode ray tube display unit.

34. Apparatus as claimed in claim 31 in which means are provided for applying bias to said toner during toning in response to the charge potential sensed at the end of the charging period.

35. Apparatus as claimed in claim 31 in which said housing and said carrier have means for maintaining said electrophotographic film member in darkness during charging and toning.

36. Apparatus as claimed in claim 31 in which there is disposed a source of energy sufficient fully to discharge the electrophotographic film, said energy source located along the return path of said film to said housing.

37. Apparatus for temporarily recording a light pattern on electrophotographic film having a photoconductive coating and projecting said recorded light pattern in a large scale display upon a screen surface, said apparatus comprising:

carrier means for holding at least one electrophotographic film member, a housing providing a lighttight enclosure and arranged to receive said electrophotographic film member in a lighttight relationship therewith, said film member having a photoconductive coating, a light pattern source exterior of said housing, projection means exterior of said housing arranged to apply said light pattern to said photoconductive coating, means within the housing proximate to said film member for charging the coating while same is in darkness, means for sensing the absolute potential of the charged coating and simultaneously, for sensing the flux of said light pattern and deriving respective signals from the potential and flux, a control circuit operated by said signals and having a predetermined characteristic which provides an output signal for any level of light flux when the charge potential sensed reaches a chosen value corresponding to any particular flux level and built into said characteristic, means driven by the output signal of the control circuit to disable said charging means and simultaneously to expose said charged coating to said light pattern, means within said enclosure for applying toner to the film member subsequent to exposure thereof, means for adjusting the time of toning and disabling said toner means after a predetermined time interval: said film member being immobilized during the charging, exposure and toning thereof, a projector arrangement, including a light source and an optical train, arranged spaced from said housing for receiving the toned electrophotographic film member and capable of projecting the recorded light pattern upon the screen surface, toner removal means arranged spaced form said projector means and adapted to receive said toned electrophotographic film subsequent to projection for removal of all toner therefrom and means for stepwise translating said carrier means to bring said electrophotographic film member successively to said housing, said projection means, said toner removal means and again to said housing in that order, and said carrier means comprises a disk member arranged for stepwise rotation to deliver said electrophotographic film member along the path intercepted by said housing, said projection means and said toner removal means successively and returning to said housing means.

* * * * *

UNITED STATES PATENT AND TRADEMARK OFFICE

CERTIFICATE OF CORRECTION

PATENT NO. : 3,936,178

DATED : February 3, 1976

INVENTOR(S) : Manfred R. Kuehnle

It is certified that error appears in the above-identified patent and that said Letters Patent are hereby corrected as shown below:

In column 2 of Abstract, line 10, change "afer" to --after--.
In column 1, line 38, change "large" to --image--.
In column 3, line 35, after "film" insert --used--.
In column 4, line 35, change "which" to --with--.
In column 6, line 1, change "large" to --image--.
In column 7, line 62, change "above" to --close--.
In column 8, line 13, change "developed" to --designated--.
In column 10, line 25, change "illustrated" to --illuminated--.
In column 10, line 40, change "high" to --light--.
In column 11, line 35, change "46" to --44--.
In column 13, line 2, change "includes" to --include--.
In column 16, line 44, change "operable" to --operating--.
In column 21, line 36, after "means" insert --within said--.

Signed and Sealed this

Fourth Day of January 1977

[SEAL]

*Attest:*

RUTH C. MASON
*Attesting Officer*

C. MARSHALL DANN
*Commissioner of Patents and Trademarks*